US006116634A

United States Patent [19]

Mometti

[11] Patent Number: 6,116,634

[45] **Date of Patent: *Sep. 12, 2000**

[54] FASTENER FOR A SNOW BOARD

[75] Inventor: Fabrizio Mometti, Trevignano, Italy

[73] Assignee: PIDA S.r.l., Treviso, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/839,927

[22] Filed: Apr. 21, 1997

[30] Foreign Application Priority Data

Aug. 21, 1996 [IT] Italy ..... MI96A1770

[51] Int. Cl.[7] ..... A63C 9/10

[52] U.S. Cl. ..... 280/613; 280/14.2; 280/616

[58] Field of Search ..... 280/14.2, 613, 280/618, 625, 626, 631

[56] References Cited

U.S. PATENT DOCUMENTS

| | | | |
|---|---|---|---|
| 5,647,148 | 7/1997 | Meiselman | 36/115 |
| 5,727,797 | 3/1998 | Bowles | 280/14.2 |
| 5,769,446 | 6/1998 | Borsoi | 280/623 |
| 5,820,155 | 10/1998 | Brisco | 280/607 |
| 5,997,027 | 12/1999 | Jungkind | 280/617 |
| 6,003,839 | 12/1999 | Hansen | 280/624 |
| 6,007,077 | 12/1999 | Moe | 280/14.2 |

FOREIGN PATENT DOCUMENTS

| | | |
|---|---|---|
| 2631843 | 12/1989 | France . |
| 4416023 | 10/1995 | Germany . |
| 95 33534 | 12/1995 | WIPO . |
| 96 40390 | 12/1996 | WIPO . |

*Primary Examiner*—Kevin Hurley
*Assistant Examiner*—Andrew J. Fischer
*Attorney, Agent, or Firm*—Pitney, Hardin, Kipp & Szuch, LLP.

[57] ABSTRACT

A fastener for a snow board comprises a U-shaped heel element and a collar band which are pivoted on a plate-shaped base and moved in a pincer-like manner by means actuated by the foot of the skier.

7 Claims, 4 Drawing Sheets

FASTENER FOR A SNOW BOARD

BACKGROUND OF THE INVENTION

1. Field of the Invention

The present invention relates to a fastener for a snow board.

2. Description of the Prior Art

It is known that, among the various generally acknowledged disadvantages of snow-board fasteners which are currently in use, the one which is the most important and as yet has not been overcome (notwithstanding the many attempts to this end) is essentially that all the operations associated with such a fastener (locking, unlocking, easing the locking tension, adjusting this tension etc.) still require manual intervention by the skier. The importance of this disadvantage, which is directly linked to the structural characteristics of snow-board fasteners of known type, is due to the fact that the abovementioned operations, which on the whole take place frequently during sporting activity are generally carried out in conditions which are difficult as a result of snow and ice on the fasteners, intense cold and fatigue.

SUMMARY OF THE INVENTION

The main object of the present invention is to make available a fastener for a snow board which is capable of overcoming the abovementioned disadvantage of the prior art completely and advantageously, that is to say to make available a fastener which has structural and functional characteristics such that the operations associated with its functioning and proper use can be carried out without any manual intervention and without, as a result of this, neglecting those characteristics of safety, of reliability and of functional reliability which are normally required of similar devices.

This object as well as others which will emerge more clearly from the description which follows, are achieved by a fastener for a snow board according to the invention, comprising:

- a plate-shaped base which is equipped on opposite sides with respective raised edges which give it an essentially hull-like shape which is open towards the front and rear sides of the base;
- an essentially U-shaped heel element with wings extending towards said front side of the base, said wings being pivoted, at an intermediate point on themselves and with a common pivoting axis, on the opposite edges of said base;
- a semi-annular collar band with its opposite ends connected to the ends of respective flat levers which are pivoted, with a common pivoting axis, on the opposite edges of said base in a position on this at a distance from said pivoting axis of the heel element, towards the front side of the base;
- means of angularly moving said heel element and said flat levers with the associated collar band about the respective pivoting axes with an essentially pincer-like mutual movement, from an open position, in which said heel element and said collar band are moved apart from each other to allow rear entry, to a closed position in which said heel element and said collar band are moved together again;
- means also being provided for anchoring at least one of said heel element, said collar band and said flat levers to said base.

The characteristics and advantages of a fastener for a snow board according to the invention will become clearer from the description of a preferred embodiment thereof which is given below with reference to the attached drawings which are given only by way of non-limiting indication.

DESCRIPTION OF THE PREFERRED EMBODIMENT

Figure 1:
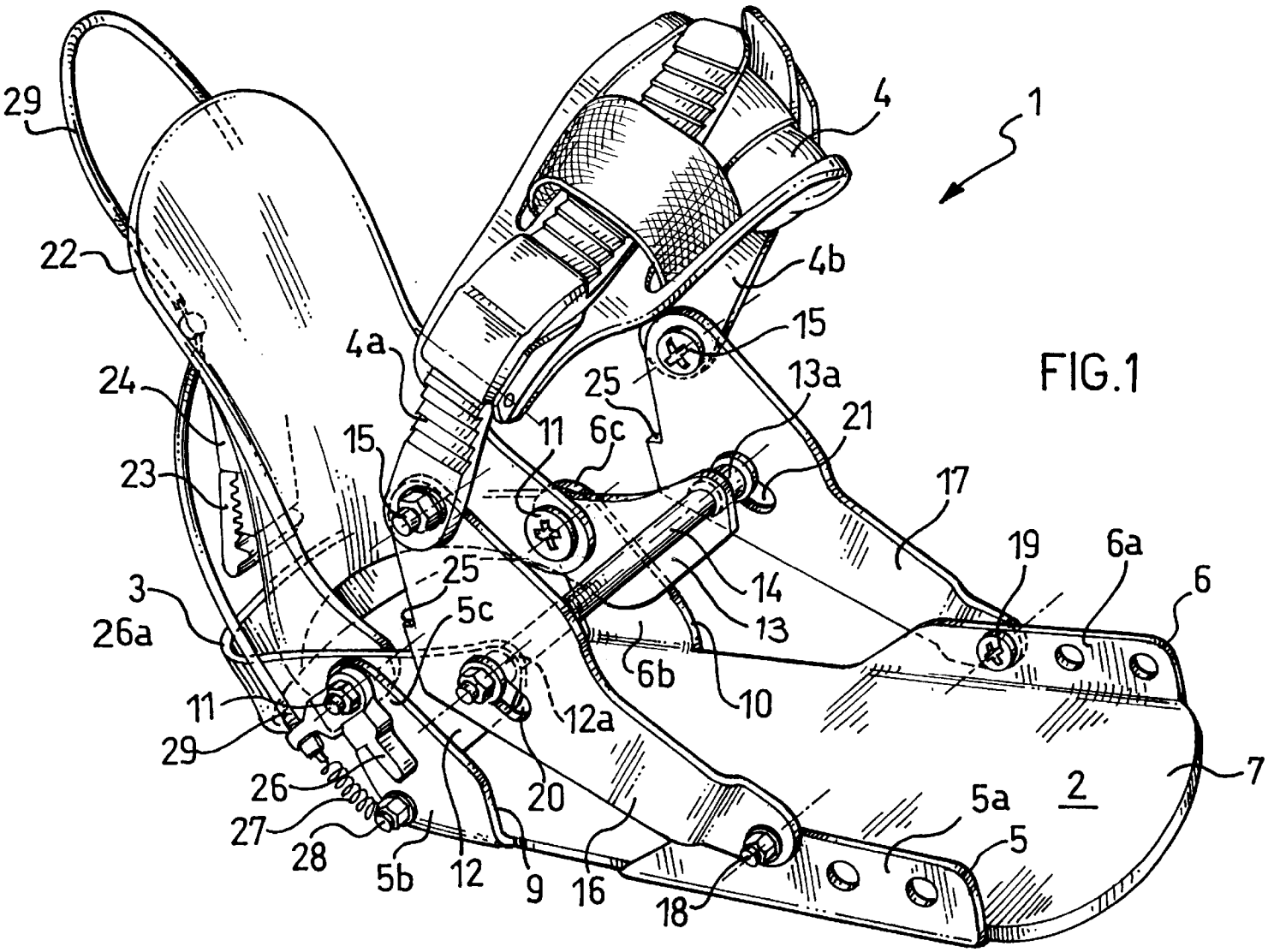
FIG. 1 represents diagrammatically in perspective a fastener for a snow board according to the invention.

With reference to the abovementioned figures, 1 indicates, as a whole, a fastener for a snow board according to the present invention. It comprises a plate-shaped base 2 which is preferably rectangular, a heel element 3 and a semi-annular collar band 4, which are mutually connected in the manner which is described below.

The plate-shaped base 2 is equipped, along its opposite longer sides, with identical raised edges 5, 6 which give it an essentially hull-like shape which is open on the shorter front 7 and rear 8 sides of said plate-shaped base.

In each of said edges 5, 6, a respective notch 9, 10 is formed, which is open on the upper side of the edges. Said notches 9, 10 subdivide the respective edges 5, 6 into two sections: front sections 5*a*, 6*a* and rear sections 5*b*, 6*b*. Said rear sections 5*b*, 6*b* are extended by respective end-pieces 5*c*, 6*c* which extend towards the rear of the plate-shaped base 2 and are inclined away from said base (FIG. 1).

The heel element 3 is essentially U-shaped with flat wings 12, 13 which are attached from behind on to the plate-shaped base 2, inside and in substantial contact with the edges 5*b*, 6*b* thereof.

In particular, the opposite flat wings 12, 13 of said heel element 3 are pivoted, at an intermediate point on themselves, and with a common pivoting axis 11, on the free ends of the rear end-pieces 5*c*, 6*c* of said edges 5*b*, 6*b*; the heel element 3 is therefore angularly movable about said axis 11. The abovementioned flat wings 12, 13 extend beyond the axis 11 towards the front side 7 of the plate-shaped base 2 and have respective free ends 12*a*, 13*a* which are positioned in the region of the notches 9, 10 of the edges 5 and 6 of said plate-shaped base. The abovementioned free ends 12*a*, 13*a* of the heel element 3 are mutually connected by a pin 14 which projects outside these. Two identical flat levers 16, 17 have a respective end fulcrumed, with a common fulcruming axis 18, 19, on the front sections 5*a*, 6*a* of the edges 5, 6 of the plate-shaped base 2.

Said flat levers 16, 17 are arranged outside and in substantial contact with the edges 5*a*, 6*a* and extend towards the rear side 8 of the plate-shaped base 2.

Pivoted on the other ends of said levers 16, 17, with a common pivoting axis 15, 15, are the opposite ends 4*a*, 4*b* of the collar band 4. Consequently, the collar band 4 is angularly movable in relation to the levers 16, 17 and is angularly movable with these about the fulcrum axis 18, 19.

Said flat levers 16, 17 are also equipped, at an intermediate point on themselves, with identical slot-shaped holes 20, 21, in which the opposite ends of the pin 14, which project from the flat wings 12, 13 of the heel element 3, are movably guided and engaged.

Positioned inside the heel element 3 and structurally independent thereof is a spoiler 22 which is pivoted on the opposite end-pieces 5*c*, 6*c* of the edges 5, 6 of the plate-shaped base 2.

A stop block 23 is mounted slidably in a guide 24 which is formed integrally at the rear in the spoiler 22 and is open on the lower contour of the spoiler. The stop block 23 is adjustably positionable in said guide 24 and removably fixable in the preselected position. Said stop block 23 is intended to interact with the heel element 3 (by resting on the upper edge thereof) in some operating stages of the fastener for a snow board according to this invention, as will emerge from the rest of the description.

Having described the structural characteristics of the fastener for a snow board according to the invention, its functioning will now be described.

Figure 2:
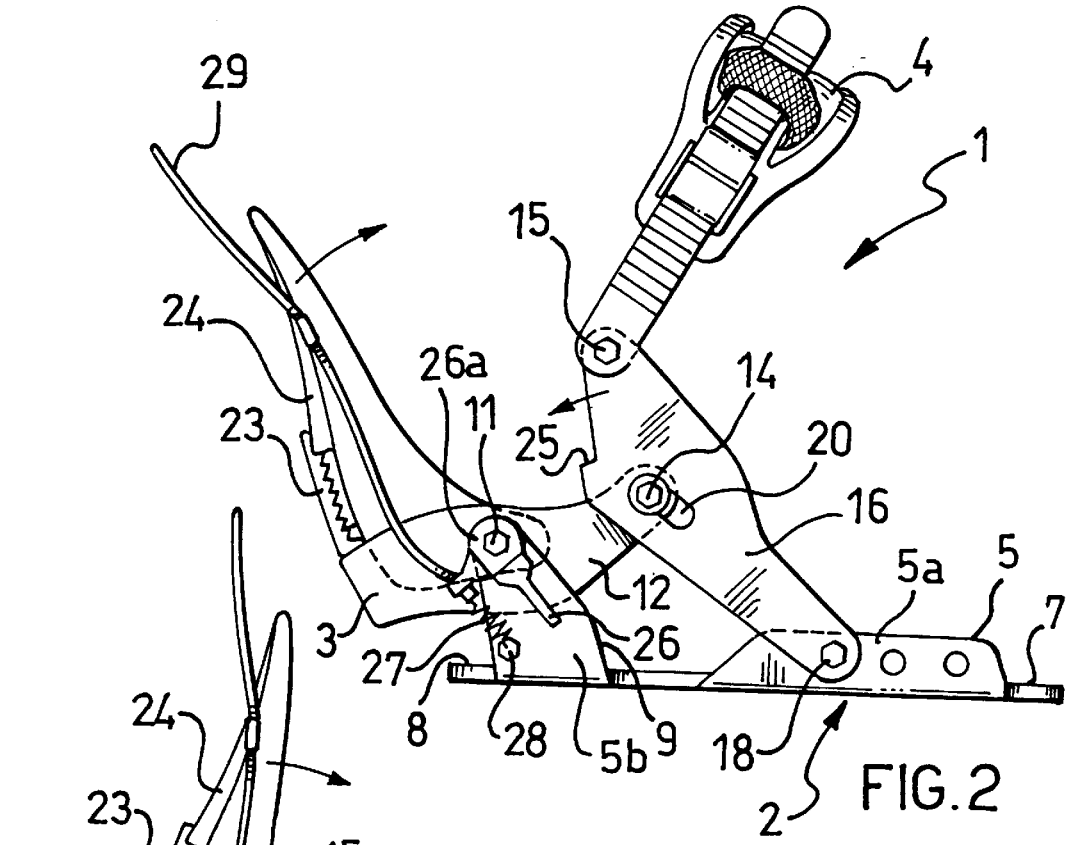
FIGS. 2 to 4 represent diagrammatically in a lateral view and on reduced scale the same fastener for a snow board as in FIG. 1 in various operating states.

In an initial state (FIG. 2), the fastener 1 described above is in an open position, ready to receive, by rear entry, one foot of the skier, suitably protected by appropriate snotches footwear, for example a ski boot.

In this initial state, the heel element 3 and the flat levers 16, 17 (which bear the collar band 4) are in the position in which they are as far apart as allowed by the length and by the shape of the slot-shaped holes 20, 21 in the flat levers 16, 17, in which the pin 14 is engaged.

With the abovementioned rear entry, the foot of the skier encounters and then presses downward, i.e. depresses the pin 14 towards and against the base 2. The edges 5, 6 of the base 2 do not interfere with the movement of the pin 14, which is an angular movement in the clockwise direction (with reference to the figures) about the pin 11, 11, because of the opposite notches 9 and 10 formed in these edges.

With this movement, the depressible pin 14 "draws along" with it on the one hand the heel element 3 with which it is integral and on the other hand and simultaneously the opposite flat levers 16, 17 with the associated collar band 4.

Figure 3:
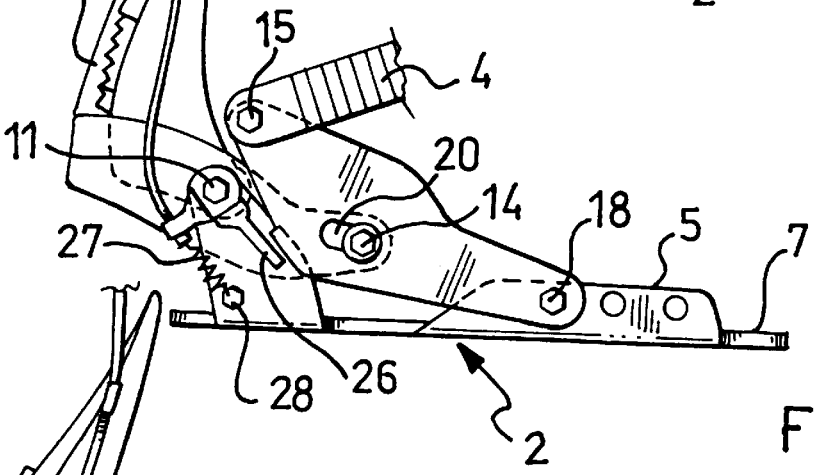
Figure 4:
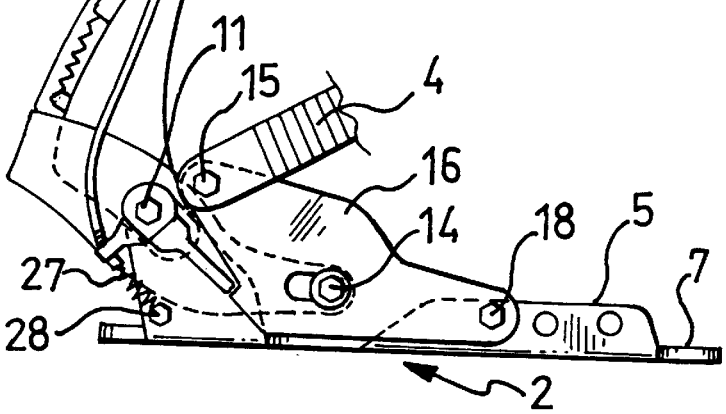
Figure 5:
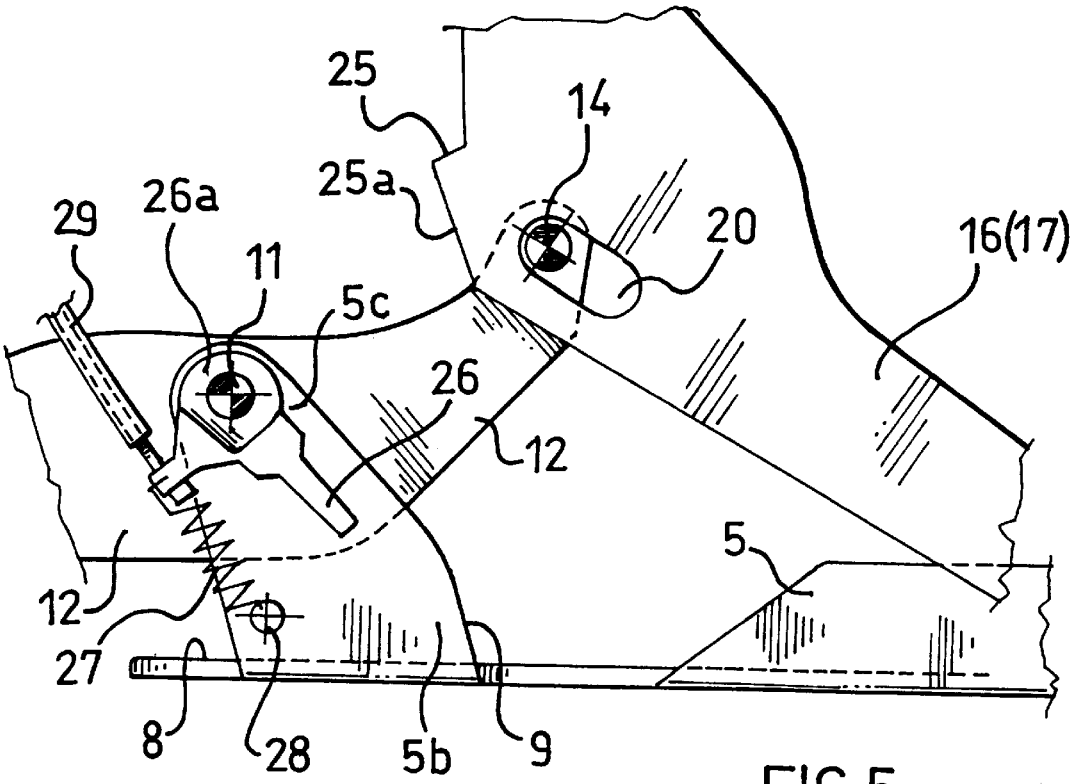
FIG. 5 is an enlarged view of a detail of FIG. 2.
Figure 6:
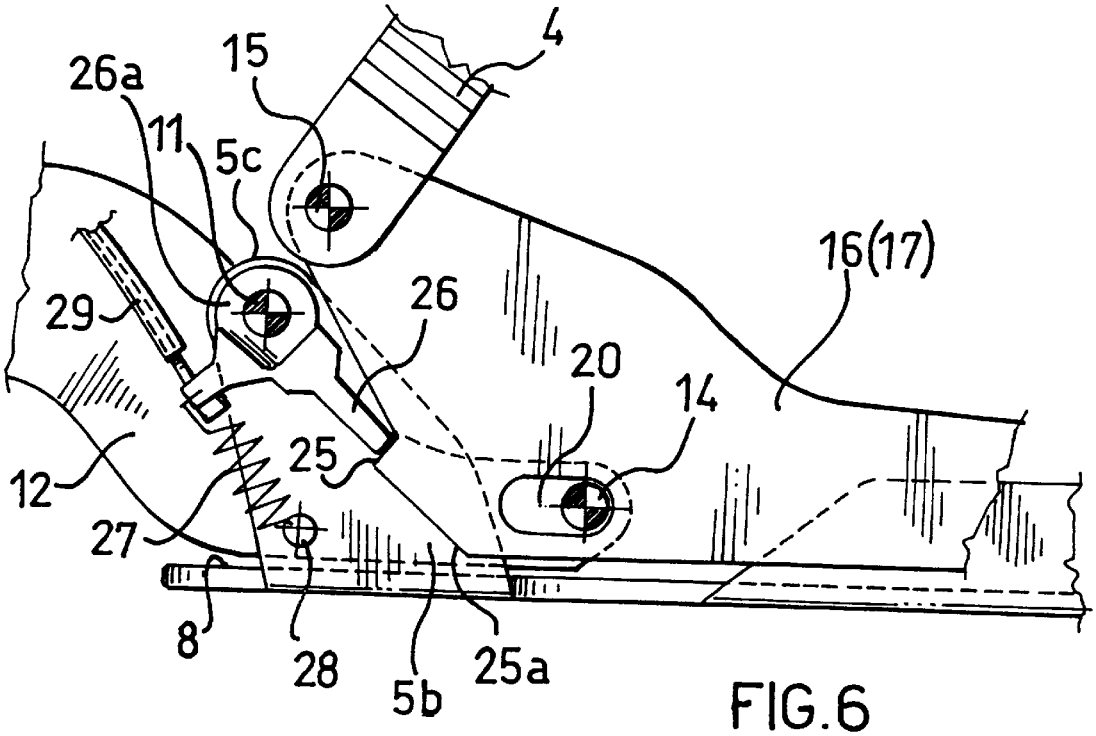
FIG. 6 represents, also on enlarged scale, the same detail of FIG. 5 in a different operating state.
Figure 7:
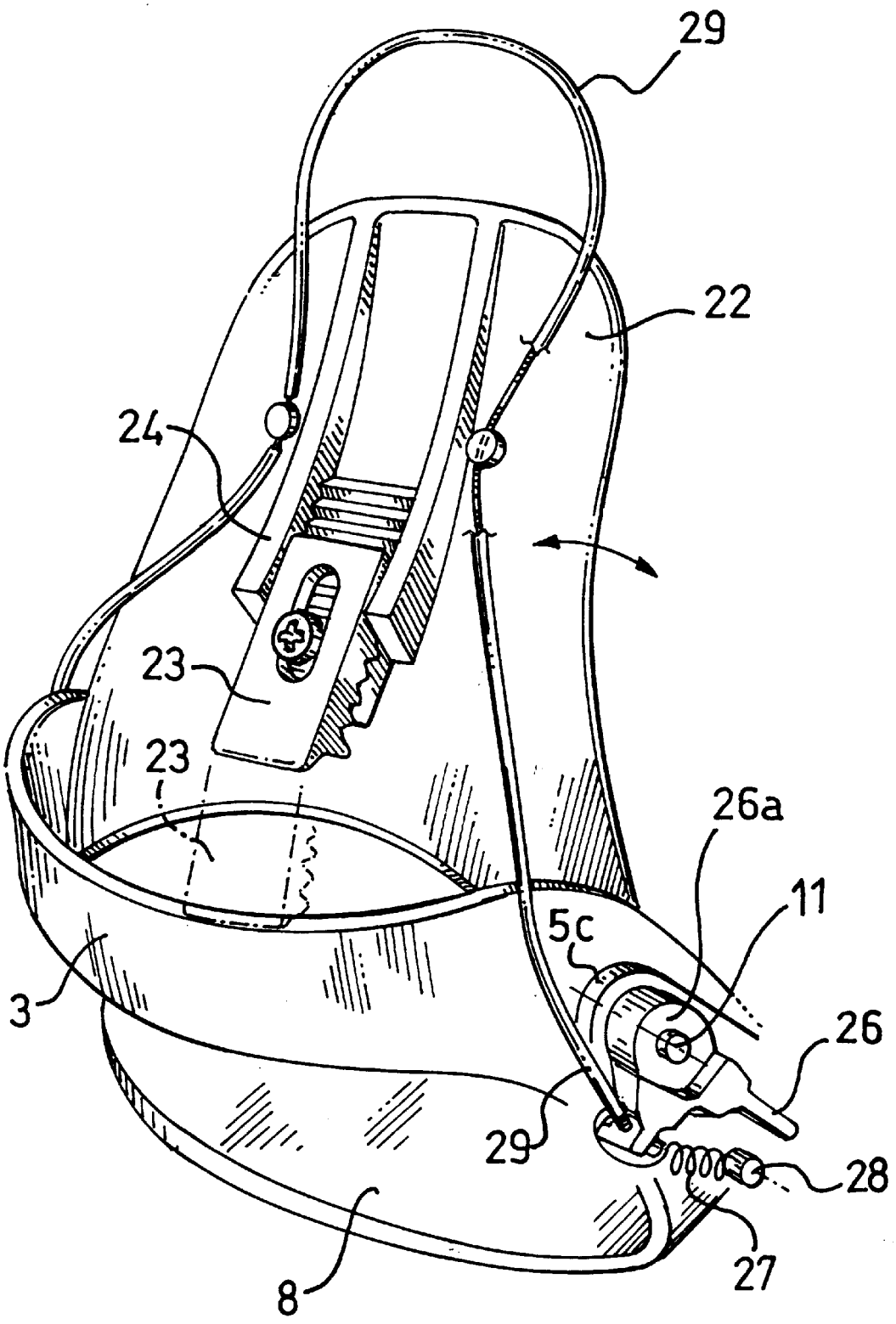
FIG. 7 represents in perspective in a rear view a detail of the fastener for a snow board in FIG. 1.

Consequently (FIGS. 3 and 4), the heel element 3 and the collar band 4 move closer together with an essentially pincer-like movement and close over the booted foot of the skier.

At this point, subject to locking of the fastener for a snow board according to the present invention in the abovementioned closed position, the skier can begin any sporting activity which is desired.

In accordance with a preferred embodiment of this invention, locking takes place automatically at the same time as the abovementioned pincer-like "closure" of the fastener is completed.

To this end (FIG. 2), a tooth 25 is formed in the lower side of each flat lever 16, 17, said tooth interacting with a respective rod-shaped pawl 26 which is pivoted on the corresponding edge 5 of the base 2 and subject to the action of a spring 27.

In particular, and preferably, the rod-shaped pawl 26 juts out radially from a circular base 26*a* which is mounted rotatably on the same pin 11 (borne by the edge 5*c* of the base 2) as the heel element 3 and the spoiler 22 are pivoted.

Fixed tangentially to the circular base 26*a* of the rod-shaped pawl 26 is one end of the spring 27, the other end of which is fixed to a peg 28 of said edge 5*c*. Also fixed tangentially to the same circular base 26*a* is the end of a Bowden cable 29, by means of which it is possible to move the pawl 26 angularly about the pin 11 counter to the spring 27.

The length of the rod-shaped pawl 26 and the position of the tooth 25 are selected in such a manner that, on the point of the abovementioned "closed" position being reached, the back 25*a* of said tooth 25 presses on the end of the rod-shaped pawl 26, moving it angularly counter to the spring 27.

Then, when the "closed" position is reached, the back 25*a* presses beyond the rod-shaped pawl 26 so that the latter, returned by the spring 27, snaps into engagement with the tooth 25.

The levers 16, 17 are thus firmly anchored on the base 2 and are therefore positively locked in the closed position; the heel element 3 is also positively locked with these.

The operation of locking the sports footwear on a snow board is therefore achieved with great ease, automatically and without any manual intervention on the part of the skier. This locking is moreover particularly safe and reliable.

To open the fastener of this invention, it is sufficient to operate the Bowden cable, pulling it so as to disengage, counter to the springs 27, the rod-shaped pawls 26 from the respective teeth 25. Once this disengagement has been effected, the skier simply has to "press" on the heel element 3 in order to bring about the angular movement of this element about the axis pin 11 and simultaneously the angular movement in the opposite direction of the flat levers 16, 17 (with the associated collar band 4) about the axis pin 18, 19.

Pressing on the heel element 3 is effected by means of the spoiler 22 and the associated stop block 23.

What is claimed is:

1. A fastener for a snow board comprising:

a plate-shaped base having respective raised edges extending along two opposite sides thereof, an open front end and a rear end;

an essentially U-shaped heel element adjacent said rear end where opposite sides of said U-shaped heel element form wings, each wing having a front end and an intermediate part rearward of said front end, said intermediate parts being pivotally coupled to said opposite side edges of base about a first pivot axis;

opposite levers extending along said raised edges of said base and having respective front and rear ends and intermediate portions, said front ends of said levers being pivoted on the respective raised edges of said base with a common second pivoting axis which is spaced apart and forward from said first pivoting axis and situated closer than said first pivot axis to said front end of said base;

a semi-annular collar band having opposite free ends pivotally engaged to the respective rear ends of said levers;

means for angularly moving simultaneously one with respect to the other of said U-shaped heel element and said levers about their respective pivoting axes from an open position in which said heel element and said collar band are moved apart from each other to allow rear entry, to a closed position in which said heel element and said collar band are moved together again; and means for anchoring at least one of said heel element, said collar band and said flat levers to said base, wherein said means for angularly moving simultaneously one with respect to the other of said heel element and said flat levers comprises a depressible foot actuated element which is automatically actuated, when depressed and wherein said means for anchoring couples only said heel element and the front ends of said levers to said base.

2. A fastener for a snow board comprising:

a plate-shaped base having respective raised edges extending along two opposite sides thereof, an open front end and a rear end;

a heel element adjacent said rear end where opposite sides of said heel element form wings, each wing having a front end and an intermediate part rearward of said front end, said intermediate parts being pivotally coupled about a first pivot axis, to said opposite side edges of said base;

opposite levers extending along said raised edges of said base and having respective front and rear ends and intermediate portions, said front ends of said levers being pivoted on the respective raised edges of said base with a common second pivoting axis which is spaced apart and forward from said first pivoting axis and situated closer than said first pivot axis to said front end of said base;

a semi-annular collar band having opposite free ends pivotally engaged to the respective rear ends of said levers;

means for angularly moving simultaneously one with respect to the other of said U-shaped heel element and said levers about their respective pivoting axes from an open position in which said heel element and said collar band are moved apart from each other to allow rear entry, to a closed position in which said heel element and said collar band are moved together again; and means for anchoring at least one of said heel element, said collar band and said levers to said base, wherein said means for angularly moving simultaneously one with respect to the other of said heel element and said levers comprises a depressible foot actuated element which extends along said first axis and is automatically actuated when depressed.

3. A fastener for a snow board comprising:

a plate-shaped base having respective raised edges extending along two opposite sides thereof, an open front end and a rear end;

an essentially U-shaped heel element adjacent said rear end where opposite sides of said U-shaped heel element form wings, each wing having a front end and an intermediate part rearward of said front end, said intermediate parts being pivotally coupled to said opposite side edges of base about a first pivot axis;

opposite levers extending along said raised edges of said base and having respective front and rear ends and intermediate portions, said front ends of said levers being pivoted on the respective raised edges of said base with a common second pivoting axis which is spaced apart and forward from said first pivoting axis and situated closer than said first pivot axis to said front end of said base;

a semi-annular collar band having opposite free ends pivotally engaged to the respective rear ends of said levers;

means for angularly moving simultaneously one with respect to the other of said U-shaped heel element and said levers about their respective pivoting axes from an open position in which said heel element and said collar band are moved apart from each other to allow rear entry, to a closed position in which said heel element and said collar band are moved together again; and means for anchoring at least one of said heel element, said collar band and said flat levers to said base, wherein said means for angularly moving simultaneously one with respect to the other of said heel element and said flat levers comprises a depressible foot actuated element which is automatically actuated when depressed, and wherein said means for anchoring comprises:

at least one rod-shaped pawl which has one end rotatably mounted on a pin borne by one of said edges of the base, spring means urging said pawl to move angularly in a first direction about said pin, said pawl being rotatable also in a direction opposite that of said first direction counter to spring means; and a tooth formed in at least one of said flat levers for removable snap-engagement with said rod-shaped pawl.

4. A fastener for a snow board comprising:

a plate-shaped base having respective raised edges extending along two opposite sides thereof, an open front end and a rear end;

an essentially U-shaped heel element adjacent said rear end where opposite sides of said U-shaped heel element form wings, each wing having a front end and an intermediate part rearward of said front end, said intermediate parts being pivotally coupled to said opposite side edges of base about a first pivot axis;

opposite levers extending along said raised edges of said base and having respective front and rear ends and intermediate portions, said front ends of said levers being pivoted on the respective raised edges of said base with a common second pivoting axis which is spaced apart and forward from said first pivoting axis and situated closer than said first pivot axis to said front end of said base;

a semi-annular collar band having opposite free ends pivotally engaged to the respective rear ends of said levers;

means for angularly moving simultaneously one with respect to the other of said U-shaped heel element and said levers about their respective pivoting axes from an open position in which said heel element and said collar band are moved apart from each other to allow rear entry, to a closed position in which said heel element and said collar band are moved together again;

means for anchoring at least one of said heel element, said collar band and said flat levers to said base, wherein said means for angularly moving simultaneously one with respect to the other of said heel element and said flat levers comprises a depressible foot actuated element which is automatically actuated when depressed; and a rear spoiler which is positioned inside said heel element, is structurally independent of the latter and is pivoted on said first pivoting axis, said spoiler being equipped at the rear with a stop block for engaging and limiting movement of the upper edge of said heel element.

5. A fastener for a snow board comprising:

a plate-shaped base having respective raised edges extending along two opposite sides thereof, an open front end and a rear end;

an essentially U-shaped heel element adjacent said rear end where opposite sides of said U-shaped heel element form wings, each wing having a front end and an intermediate part rearward of said front end, said intermediate parts being pivotally coupled to said opposite side edges of base about a first pivot axis, opposite levers extending along said raised edges of said base and having respective front and rear ends and intermediate portions, said front ends of said levers being pivoted on the respective raised edges of said base with a common second pivoting axis which is spaced apart and forward from said first pivoting axis and situated closer than said first pivot axis to said front end of said base;

a semi-annular collar band having opposite free ends pivotally engaged to the respective rear ends of said levers;

means for angularly moving simultaneously one with respect to the other of said U-shaped heel element and said levers about their respective pivoting axes from an open position in which said heel element and said collar band are moved apart from each other to allow rear entry, to a closed position in which said heel element and said collar band are moved together again; and means for anchoring at least one of said heel element, said collar band and said flat levers to said base, wherein said means for angularly moving simultaneously one with respect to the other of said heel element and said flat levers comprises a depressible foot actuated element which is automatically actuated when depressed, wherein said levers each include a slot-shaped hole each slot-shaped hole elongated in the forward-rearward direction, and wherein said means for angularly moving simultaneously one with respect to the other of said heel element and said levers comprises a pin which is supported by said free ends of said opposite wings of said heel element, said pin being movably engaged through said slot-shaped holes respectively provided in intermediate portion of said levers.

6. A fastener for a snow board according to claim 5, wherein the opposite edges of said plate-shaped base are equipped with respective notches which are open on the upper side of said edges, in a position on the latter which cannot hinder the angular movements of said pin towards and away from said base.

7. A fastener according to claim 5 wherein said pin extends as a continuous rod from one of said wings to the other of said wings.

* * * * *